United States Patent [19]

Winkelmann et al.

[11] 4,040,735

[45] Aug. 9, 1977

[54] APPARATUS FOR MICROFILM RE-ENLARGEMENT

[75] Inventors: Detlef Winkelmann, Wiesbaden-Biebrich; Bernd Löhr; Helmut Stieger, both of Wiesbaden, all of Germany

[73] Assignee: Hoechst Aktiengesellschaft, Germany

[21] Appl. No.: 616,476

[22] Filed: Sept. 24, 1975

Related U.S. Application Data

[60] Continuation of Ser. No. 423,721, Dec. 11, 1973, abandoned, which is a division of Ser. No. 319,198, Dec. 29, 1972.

[30] Foreign Application Priority Data

Dec. 31, 1971 Germany ..... 2165901

[51] Int. Cl.[2] ..... G03G 15/02

[52] U.S. Cl. ..... 355/10; 96/1 C; 361/225

[58] Field of Search ..... 355/3 R, 3 DD, 10, 11, 355/14, 17; 96/1 C, 1 LY; 117/37 LE; 317/262 A; 118/637, DIG. 23

[56] References Cited

U.S. PATENT DOCUMENTS

| | | | |
|---|---|---|---|
| 2,890,968 | 6/1959 | Giaimo | 355/16 X |
| 3,049,968 | 8/1962 | Johanson | 355/3 R X |
| 3,788,844 | 1/1974 | Sato et al. | 117/37 LE X |
| Re. 28,568 | 10/1975 | Saito et al. | 355/10 X |

*Primary Examiner*—L. T. Hix
*Assistant Examiner*—Kenneth C. Hutchison
*Attorney, Agent, or Firm*—James E. Bryan

[57] ABSTRACT

Apparatus for producing positive enlarged copies from positive or negative microfilm, in which the photoconductive element can be charged either negatively or positively so that one developing liquid containing particles of only one polarity can be used to create positive copies regardless of whether the original microfilm is positive or negative. The apparatus includes a reusable photoconductive web having an aluminum backing, a perforated development electrode, and a transfer station for transferring the developed image to paper.

2 Claims, 4 Drawing Figures

E

Figures 1A, 1B:
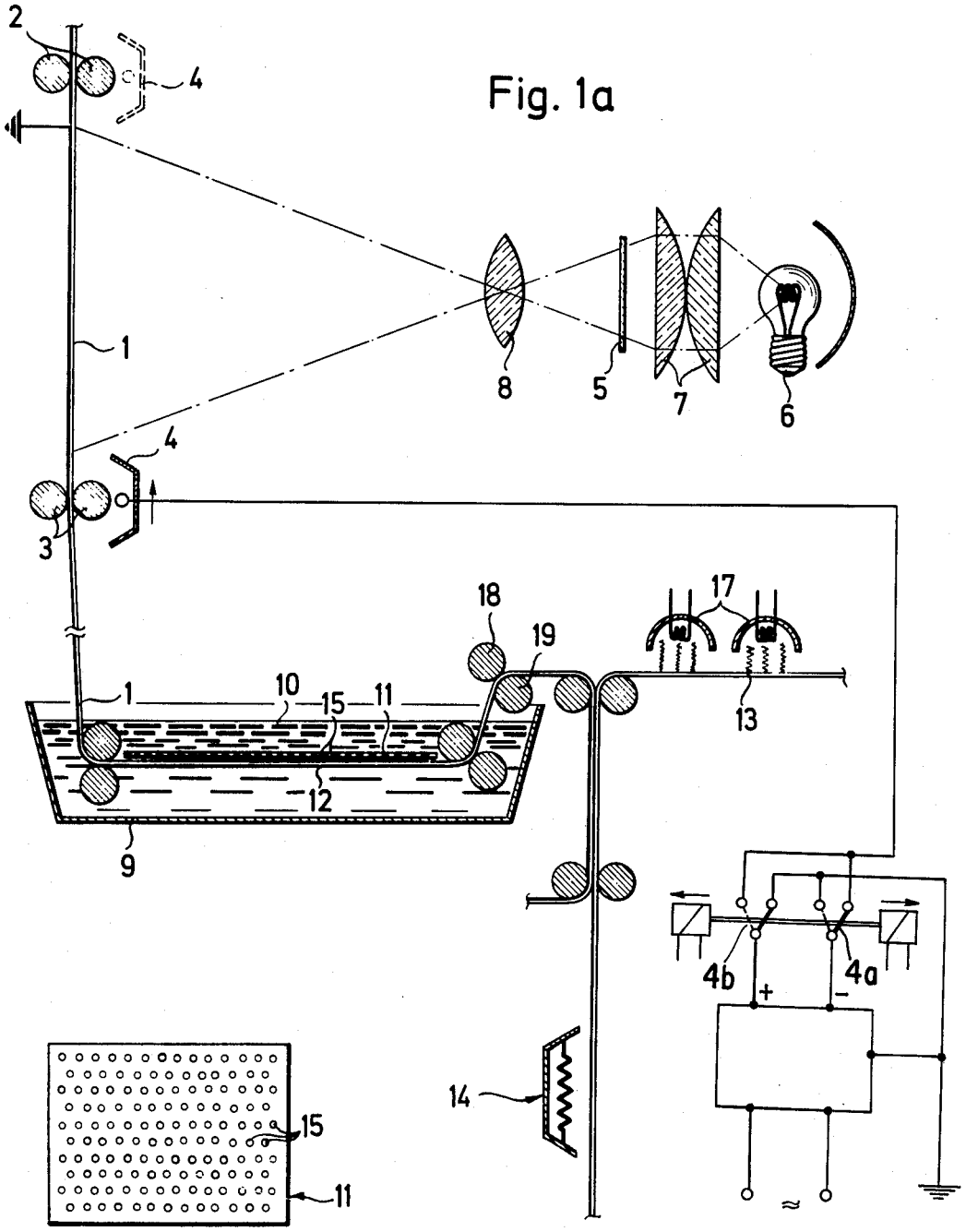

II
III
I
IV
400
500
600
700 [nm]

E

I
II
III
IV
400
500
600
700
[nm]

APPARATUS FOR MICROFILM RE-ENLARGEMENT

This is a continuation of application Ser. No. 423,721, filed Dec. 11, 1973, now abandoned, which is, in turn, a division of U.S. Ser. No. 319,198, filed Dec. 29, 1972.

This invention concerns improvements in and relating to microfilm re-enlargement.

Processes for the re-enlargement of microfilm originals are known and have been used in practice successfully in which are enlarged image of the microfilm original is projected on a uniformly charged photoconductor, the resulting charge pattern is electrostatically developed and the toner image is transferred to a copy support. However, there is still a great need for a microfilm re-enlargement process which can be used for the production of positive copies of both negative and positive originals. While it is further known that, by using separate toners which can assume different charges, a negative or a positive image, as the case may be, can be produced electrophotographically from one and the same original, such processes have not found acceptance since it requires exceptional technical effort and expenditure to produce a single apparatus in which it is possible to work with two different developer substances.

British Patent No. 1,176,001, describes an electrophotographic process in which, to permit a positive copy to be produced starting from a positive or from a negative as the original, a photoconductor is coated with a liquid and the photoconductor coated in this way is charged and subsequently developed with liquid developer. This process is extremely expensive and prone to breakdown.

Apparatus is also obtainable working with zinc oxide paper and allowing positive and negative charging. However, zinc oxide paper processes are known to possess disadvantages. A particularly objectionable feature is that is is not possible to work with ordinary paper.

The present invention provides a process for the re-enlargement of a positive or negative microfilm original, wherein an enlarged image of the microfilm original is projected on a photoconductor uniformly charged negatively or positively respectively, the photoconductor including a polymeric condensation product of formaldehyde or paraformaldehyde and at least one polynuclear, carbocyclic, optionally substituted aromatic compound, the condensation product consisting of recurring non-crosslinked units of the formula

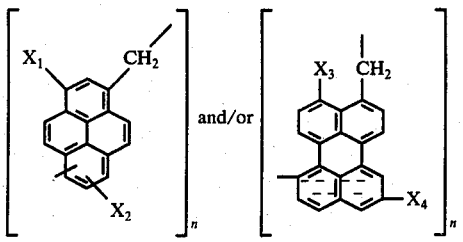

in which $X_1$ and $X_2$ are the same or different and denote hydrogen, alkyl or alkoxy each with 1 to 4 carbon atoms, or halogen, especially chlorine or bromine, $X_3$ and $X_4$ are the same or different and denote alkyl or alkoxy each with 1 to 4 carbon atoms, or halogen, especially chlorine or bromine, and $n$ denotes an integer between about 6 and 10, and after a resulting image-wise exposure the charge image is electrostatically developed with a developer liquid.

The developer liquid preferably contains a resin of high molecular weight which is dispersed or suspended in a liquid short-chain hydrocarbon having a Kauri butanol number of below 30 in which it is insoluble, the resin optionally containing a plasticizer or a solvent and/or a coloring constituent. By means of this process it is possible to produce a positive enlargement on ordinary paper both of a negative and of a positive microfilm image, using one and the same developer.

The condensation product is preferably mixed with one or more activators, and optionally binders, and further additives. The developed image is normally transferred from the photoconductor to a copy support.

A condensation product from 3-bromopyrene as the polynuclear carbocyclic aromatic compound is preferred. It is particularly advantageous if the condensation product additionally contains bianthryl units condensed therein. Best results are achievable using a photoconductor which contains 0.1 to 0.4 mole of activator per mole of monomer base unit. The photoelectric and mechanical properties of the photoconductor are particularly good if the photoconductor contains up to 200% by weight of binder, relative to the condensation product.

The photoconductor layers used according to the invention give a high contrast. It is assumed that this is due to the high charge which these layers can accept. Furthermore, the photoconductor layers are extremely sensitive so that it is possible to copy substantially more rapidly than with zinc oxide.

The preferred developer liquids contain, as the resin of high molecular weight, a resin of the group including vinyl toluene-acrylate copolymers, styrene-acrylate copolymers, styrene copolymers and butadiene-styrene copolymers.

To achieve particularly good transfer of the toner to the copy support it is preferred to add a minor amount of a tackifying resin to the developer. For this purpose, a resin of the group including $\alpha$-pinene, $\beta$-pinene, polymerized mixed olefins, heat-reactive synthetic hydrocarbon polymers and pentaerythritol esters of hydrogenated colophony is preferred.

It has proved very successful, and is preferred, to add a plasticizer for the resin of high molecular weight. In particular, it is possible to use a plasticizer of the group including the di-lower alkyl phthalates, especially dibutyl phthalate, dioctyl phthalate, dimethyl phthalate and diethyl phthalate, and the chlorinated polyphenyls.

A particularly good coloration or blackening can be achieved by using, in the developer liquid, a pigment which is compatible with the high molecular resin, in particular carbon black of average particle size 25 m$\mu$.

According to the invention, the preferred developer liquid is a suspension of 0.3 to 1.4% by weight of finely divided pigment with electrophoretic properties and 1.5 to 4.5% by weight of a high molecular resin in a liquid, short-chain, hydrocarbon having a Kauri butanol number of less than 30 in which the resin is substantially insoluble. A suitable resin of high molecular weight is a vinyl toluene-acrylate copolymer or a mixture of heat-active synthetic hydrocarbon polymers having an iodine number of about 130 and butadiene-styrene copolymer.

It has been found, surprisingly, that the photoconductors mentioned can be charged equally well both positively and negatively for use in electrophotography, so that a process of the type concerned is provided in which it is possible, by simply reversing the polarity of the charge on the photoconductor, to produce a positive re-enlargement from a negative microfilm just as well as from a positive microfilm. Furthermore it is possible to fix the transferred image at power ratings acceptable in practice.

A photoconductor which contains 0.22 g of dicyanomethylene-2,7-dinitrofluorene and 1 g of polyester per 2 g of 3-bromopyrene resin is particularly preferred. Using a photoconductor of this kind, it is possible to prepare copies of very good quality in long runs.

Particularly contrast-rich re-enlargements are obtained when the charge pattern on the photoconductor is developed with a liquid developer as described in the Examples below.

It is furthermore preferred, according to the invention, to effect the development using an additional external electric field. The use of an additional external electric field is known in principle in electrophotography. However, in the process according to the invention its use provides the addition advantage that large areas which are light in the original can be developed satisfactorily even if the original is a negative, i.e., when the large regions of the photoconductor which are to be colored are completely or largely discharged.

The invention further provides an apparatus for carrying out the process of the invention, the apparatus including charging means for the uniform charging of the photoconductor, exposure means for projecting an enlarged image of the microfilm original on the charged photoconductor, developing means for applying developer liquid to the photoconductor carrying a corresponding charge pattern, the developing means including, so located as to be a short distance from the photoconductor, a developing electrode which can be either insulated or subjected to a potential, transfer means for transferring the developed charge image onto a copy support, and transporting means for moving the photoconductor in sequence from one of the means to the next. The apparatus is particularly flexible if the charging means includes a high potential (mains) instrument with means, such as a switch, for reversing the sign of the high potential for the discharge elements providing the charge.

Figure 2:
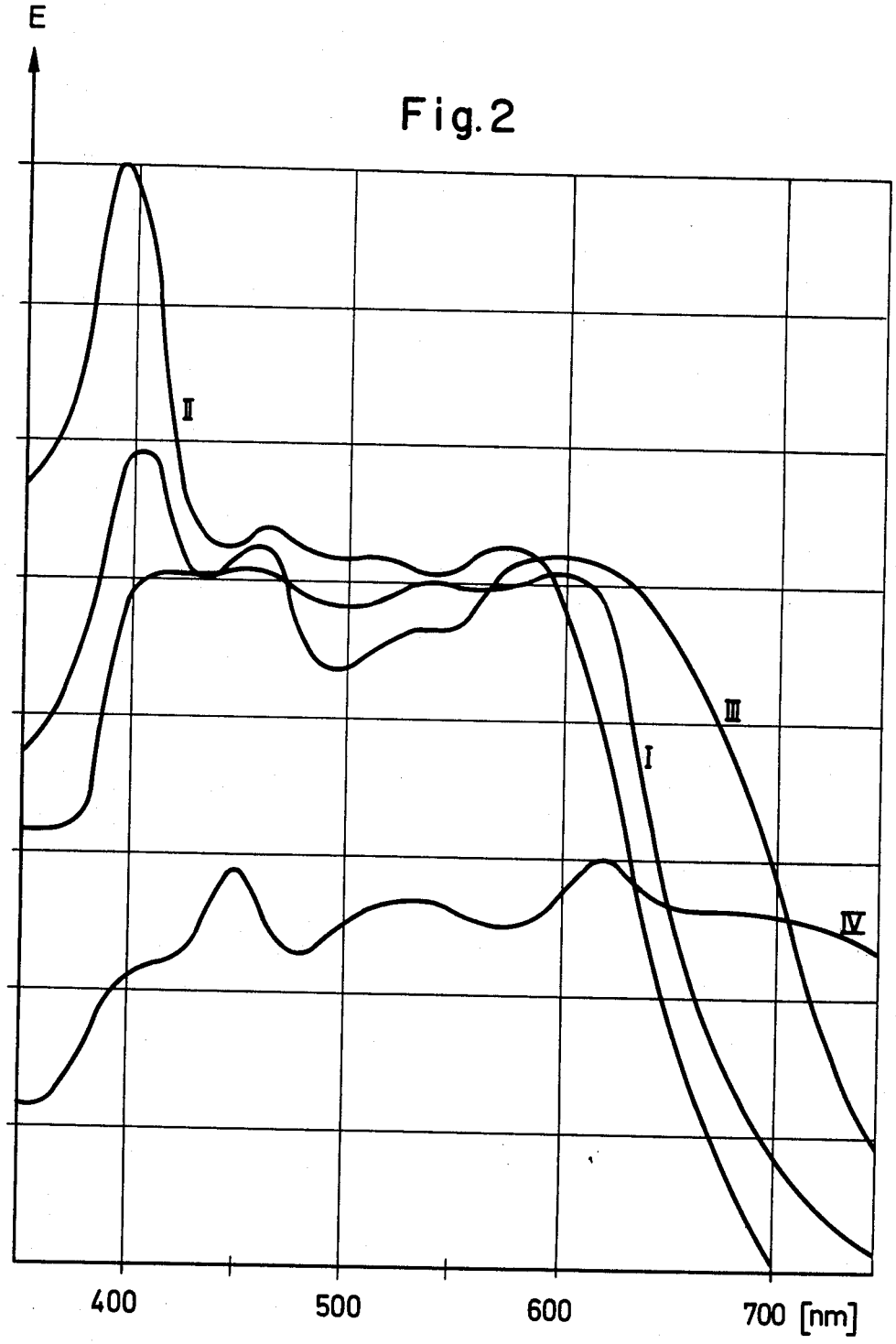
Figure 3:
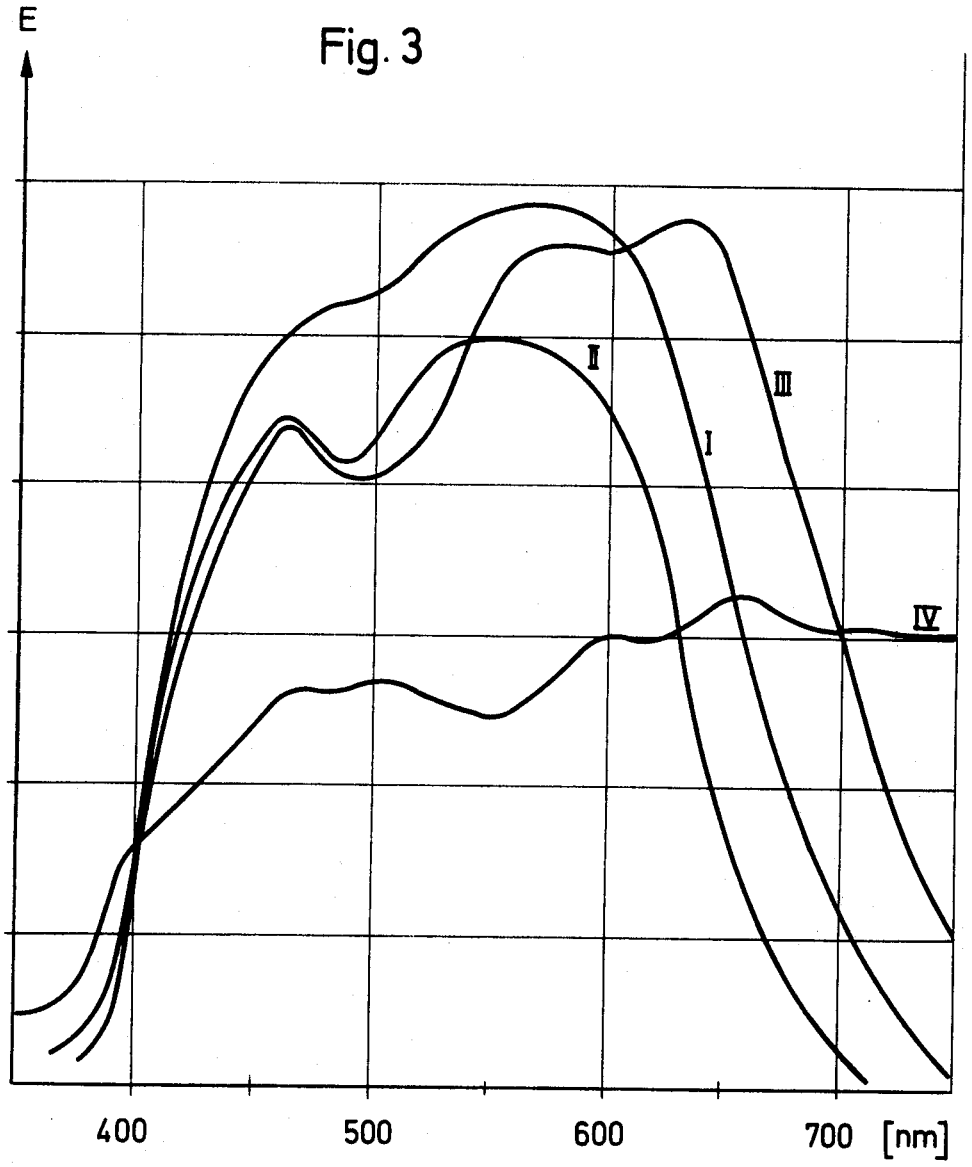

FIG. 1*a* is a diagrammatic illustration of one embodiment of the apparatus of the invention;

FIG. 1*b* shows a development electrode which forms one plate of a capacitor; and FIGS. 2 and 3 are graphs comparing the sensitivity of certain exemplary activated layers when charged positively and negatively.

The apparatus of the invention is diagrammatically illustrated by way of example in FIG. 1 of the accompanying drawings.

Referring to FIG. 1, a photoconductor web 1 as above described is moved into position between pairs of rollers 2 and 3. The photoconductor layer is charged uniformly by means of a corona discharge device 4 which travels over the photoconductor web 1 in the direction of the arrow between the full line and the broken line positions. Position 4*a* of the switch provides a negative charge and position 4*b* of the switch provides a positive charge. At the same time, the rear face of this photoconductor layer is grounded as shown. At the end of this charging process, the image-wise exposure takes place. In this operation, a microfilm original 5 is exposed by means of an exposure device consisting of a light source 6 and condenser 7 and focused by means of an optical system 8 on the charged photoconductor 1. As a result, an image-wise charged pattern is produced in known manner on the photoconductor.

Thereafter, for development, the photoconductor is passed through a trough 9 which contains a liquid developer 10. This produces a visible image of the original on the photoconductor 1. The quality of the development is improved by passing the photoconductor 1, in the developer bath, between the plates 11 and 12 of a capacitor. The aluminum vapor-coated underside of the photoconductor layer here forms one plate 12 of the capacitor. The other plate 11 is preferably a metal sheet with numerous uniformly distributed perforations 15. As a result of these perforations, the developer flow becomes very uniform. The distance of the electrode 11 from the photoconductor is approximately 0.1 – 3 mm, preferably about 1 mm. The electrode is in this case mounted in an insulated manner so that the requisite potential is set up automatically. However, if desired, the electrode 11 can be connected to a source of potential. The use of a developer electrode produces two considerable advantages in addition to the freedom from background: first, the requisite amount of light can be reduced and hence the exposure time and/or the deterioration of the microfilm original can be reduced, because the discharge of the photoconductor can be less. Secondly, the developing electrode produces the advantage, particularly in the production of re-enlargements of negative originals according to the invention, that the potential of the developing electrode prevents toner from being deposited thereon; in this case, which is the one occurring most frequently in practice, separate cleaning of the developing electrode can therefore be dispensed with.

In order to achieve a transfer of the developed image onto paper it is necessary to remove any excess of dispersion material by squeezing out with rollers 18, 19. The removal can instead be effected, for example, by an air blast.

The developed photoconductor is thereafter brought into contact with a copy receiving material, for example a paper web 13, in order to transfer the toner image to the paper. If necessary, the transferred image on the paper is fixed in a fixing zone 14. However it is preferred, according to the invention, not to use a fixing process but to heat the paper, before the transfer stage, to a temperature between about 30° and 100° C by means of a radiator 17.

Very contrast-rich images were obtained with a liquid developer which possessed the following constituents:

| Constituents | Amount |
|---|---|
| Microlith Black (pigmented resin, a Ciba product) | 13.25 g |
| Reflux Blue (dyestuff,a product of Farbwerke Hoechst AG) | 1.68 g |
| "Pliolite" VTAC (a product of Goodyear Tire & Rubber Co., Akron, Ohio) | 58 g |
| "Solprene" 1205 (a product of Phillips Petroleum Co., New York) | 63.6 g |
| "Solvesso" 100 | 151 g |
| "Isopar" G | 7.56 g |

("Solvesso" and "Isopar" G are "Esso" products)

The above-mentioned constituents, with the exception of Isopar G, are mixed on a triple-roll mill until they have formed a homogeneous paste. This paste is dispersed in 0.47 liter of Isopar G on a roll mill. 1.42 liters of Isopar G are then added and the mixture is stirred for 10 minutes with an ordinary stirrer. Finally, the concentrate is introduced into a mill and ground for 30 minutes. Before use, the concentrate is diluted in the volume ratio of 1 part of concentrate to 3 parts of Isopar G.

The resin represents the toner particles. As a result of squeezing out the excess of dispersing agent, a homogeneous tacky layer in the form of the enlarged microfilm original is formed on the photoconductor and adheres well to the paper but adheres only slightly to the photoconductor.

To produce the photoconductor, the amounts of resin, activator and polyester indicated in the Examples below were dissolved in 25 ml of tetrahydrofuran and the solution was filtered. The polyester used is the product "Dynapol®" L203 by Dynamit Nobel AG. The solution obtained is cast on a circulating conducting belt of polyester vapor-coated with aluminum. The layer obtained was dried for about 3 to 4 minutes at 110° C in a drying cabinet to remove the solvent. The half-life period, used to characterize the properties of the photoconductor, is the time within which the potential has, for a given exposure, become reduced to half the initial potential. The figures clearly show that while the layers can be charged somewhat more easily in the negative range than in the positive range, the values are so high that a microfilm re-enlargement apparatus with a reversible corona potential gives perfect copies.

The following Examples further illustrate the invention:

EXAMPLE 1

The process was carried out in the manner described above with 2 g of pyrene resin, 0.56 g of 2,4,7-trinitrofluorenone and 1.2 g of polyester. It was possible to charge the photoconductor layer obtained to + 1200 V and − 1500 V. The corresponding half-life periods were 35 and 32 msec respectively.

EXAMPLE 2

2 g of 3-bromopyrene resin, 0.56 g of 2,4,7-trinitrofluorenone and 1 g of polyester were processed in the manner described. The resulting photoconductor layer was charged to + 1250 V and to − 1600 V. The corresponding half-life periods were 32 and 28 msec respectively.

EXAMPLE 3

2 g of 3-bromopyrene resin and 0.22 g of dicyanomethylene-2,7-dinitrofluorene were processed with1 g of polyester as indicated. The layer was charged to + 1250 V and subsequently to − 1400 V. The half-life periods were 15 and 10 msec respectively.

EXAMPLE 4

2 g of 3-bromopyrene resin, 0.25 g of dicyanomethylene-2,4,7-trinitrofluorene and 1 g of polyester were cast as described to give a photoconductor layer. The layer was charged to + 1100 V and subsequently to − 1300 V, giving half-life periods of 15 and 10 msec respectively.

Using the photoconductor described, and the indicated developer, it was possible to produce, from one and the same microfilm original, positive and negative re-enlargements by merely reversing the sign of the corona potential. This provides a process which offers, for the first time, the possibility of obtaining positive copies from any desired microfilm original by corresponding setting of the sign of the corona potential, without other interruption of the process.

A particular advantage of the process according to the invention is the possibility of sensitization for particular spectral ranges by the choice of various acceptors or combinations thereof. This makes it possible to adapt the photoconductor optimally both to the exposure conditions in the copying instrument and also to the particular original (silver film or SM - diazo film).

Referring to FIGS. 2 and 3 of the accompanying drawings, compared therein are the sensitivity of certain exemplary activated layers when charged positively and negatively. The sensitivity is expressed as the reciprocal half-life. The ratio of monomer structural unit/activator is in all cases 1:0.1; this ratio was chosen merely for comparison purposes but does not indicate the particular optimum activation. From the large number of available activators, four different activators were chosen, namely I. 2,4,7-Trinitrofluorenone
II. 9-Dicyanomethylene-2-nitrofluorene
III. 9-Dicyanomethylene-2,7-dinitrofluroene
IV. 9-Dicanomethylene-2,4,7-trinitrofluorene.

The corresponding curves are marked with the corresponding Roman numerals.

FIG. 2 shows that the acceptor 9-dicyanomethylene-2-nitrofluorene (curve II) produces a particularly high sensitivity in the range between 350 and 600 nm. A layer sensitized with this acceptor is particularly advantageous for lamps which have their emission maximum in this range, such as, for example, fluorescent lamps supplied by General Electric under the name of "Daylight," "Chroma 55" and "Chroma 70" fluorescent lamps, or xenon lamps xenon flashlights. This layer is not only optimally adapted to the lamps but is at the same time particularly suitable for the re-enlargment of diazo-based microfilms (3M-diazo film), since their contrast between blackened and non-blackened areas is greatest in this range.

A shift in the spectral sensitivity in the long wavelength range of the spectrum may be achieved by activation with 9-dicyanomethylene-2,7-dinitrofluorene (curve III). This layer has very high sensitivity both when using fluorescent lamps and xenon lamps, and when using tungsten lamps or halogen lamps. Such a spectral sensitivity distribution permits the re-enlargement of silver halide microfilms and diazo microfilms.

A further shift in the spectral sensitivity in the long wavelength range results when using 9-dicyanomethylene-2,4,7-trinitrofluorene (curve IV). This photoconductor layer is particularly sensitive when using tungsten lamps or halogen lamps, since here the high proportion of red from these lamps can be utilized. This layer is outstandingly suitable for the re-enlargement of silver halide films. As can be further seen from FIGS. 2 and 3, a very uniform sensitization is achievable over a wider range of the visible spectrum by the use of 2,4,7-trinitrofluorene (curve I). Such a layer is very suitable for use with xenon lamps or xenon flashlights.

In the case of a negative charge (see FIG. 3), essentially the same picture results. The only difference is that in the short wavelength range the sensitivity begins to be noticeable only at 400 nm, while in the long wavelength range of the visible spectrum the sensitivity is somewhat greater. By choosing lamps the emission of which covers a broad range of the spectrum, the same sensitivity is achievable with a negative charge as with a positive charge.

A particular advantage of the process according to the invention is that almost 100% transfer of the toner image from the photoconductor to ordinary paper is achievable. Hence at most a slight cleaning is required, which reduces the mechanical wear of the photoconductor. The paper preferably used has a high absorbency and surface smoothness and low air permeability, and suitable stiffness.

It will be obvious to those skilled in the art that many modifications may be made within the scope of the present invention without departing from the spirit thereof, and the invention includes all such modifications.

What is claimed is:

1. An apparatus for the re-enlargement of a positive or negative microfilm original comprising charging means for the uniform charging negatively or positively respectively of a photoconductor which includes a high potential device with means for reversing the sign of the high potential for discharge elements providing the charge, exposure means for projecting an enlarged image of a microfilm original onto said charged photoconductor, developer means for applying one and the same developer onto said photoconductor, said developer means including a trough adapted to contain a liquid developer including particles having one polarity only, a developing electrode mounted in an insulated manner and having numerous uniformly distributed perforations, the electrode being located a short distance from the photoconductor in a developer bath and adapted to form a capacitor together with an aluminum vapor-coated conductive backside of the photoconductor when said photoconductor is arranged between both capacitor plates, transfer means for transferring a developed charge image onto a copy support, and means for moving the photoconductor through the apparatus.

2. An apparatus for the re-enlargement of a positive or negative microfilm original comprising charging means for the uniform charging negatively or positively respectively of a photoconductor which includes a high potential device with means for reversing the sign of the high potential for discharge elements providing the charge, exposure means for projecting an enlarged image of a microfilm original onto said charged photoconductor, developer means for applying one and the same developer onto said photoconductor, said developer means including a trough adapted to contain a liquid developer including particles having one polarity only, a developing electrode connected to a source of potential and having numerous uniformly distributed perforations, the electrode being located a short distance from the photoconductor in a developer bath and adapted to form a capacitor together with an aluminum vapor-coated conductive backside of the photoconductor when said photoconductor is arranged between both capacitor plates, transfer means for transferring a developed charge image onto a copy support, and means for moving the photoconductor through the apparatus.

* * * * *